US009022826B1

(12) United States Patent
Bannister et al.

(10) Patent No.: US 9,022,826 B1
(45) Date of Patent: May 5, 2015

(54) SAFETY BELT SWIM TRAINER

(71) Applicants: Ann A. Bannister, Woodside, NY (US); Basil A. Bannister, Jr., Woodside, NY (US)

(72) Inventors: Ann A. Bannister, Woodside, NY (US); Basil A. Bannister, Jr., Woodside, NY (US)

( * ) Notice: Subject to any disclaimer, the term of this patent is extended or adjusted under 35 U.S.C. 154(b) by 0 days.

(21) Appl. No.: 14/184,938

(22) Filed: Feb. 20, 2014

Related U.S. Application Data

(63) Continuation of application No. 14/055,806, filed on Oct. 16, 2013.

(51) Int. Cl.

| | |
|---|---|
| ***B63C 9/11*** | (2006.01) |
| ***B63C 9/08*** | (2006.01) |
| ***B63C 9/115*** | (2006.01) |

(52) U.S. Cl.
CPC ... *B63C 9/11* (2013.01); *B63C 9/08* (2013.01); *B63C 9/115* (2013.01)

(58) Field of Classification Search
CPC ..... A63C 9/08; A63C 9/11; A63C 9/115; A63C 9/135
USPC ..... 441/88, 106
See application file for complete search history.

(56) References Cited

U.S. PATENT DOCUMENTS

| | | | | |
|---|---|---|---|---|
| 4,047,255 | A * | 9/1977 | Kiefer | 441/106 |
| 4,194,257 | A * | 3/1980 | Martin et al. | 441/80 |
| 7,037,155 | B2 * | 5/2006 | Freeman et al. | 441/106 |
| 7,255,620 | B1 * | 8/2007 | Shepherd et al. | 441/88 |

* cited by examiner

*Primary Examiner* — Lars A Olsen

(57) ABSTRACT

A safety-retrieval system comprised of three components, a life jacket with reinforced tethering points, a waist belt with tethering points to be worn around a secondary person's waist, and a tethering line/leash to connect the life jacket to the waist belt.

7 Claims, 2 Drawing Sheets

SAFETY BELT SWIM TRAINER

BACKGROUND OF INVENTION

Figure 1:
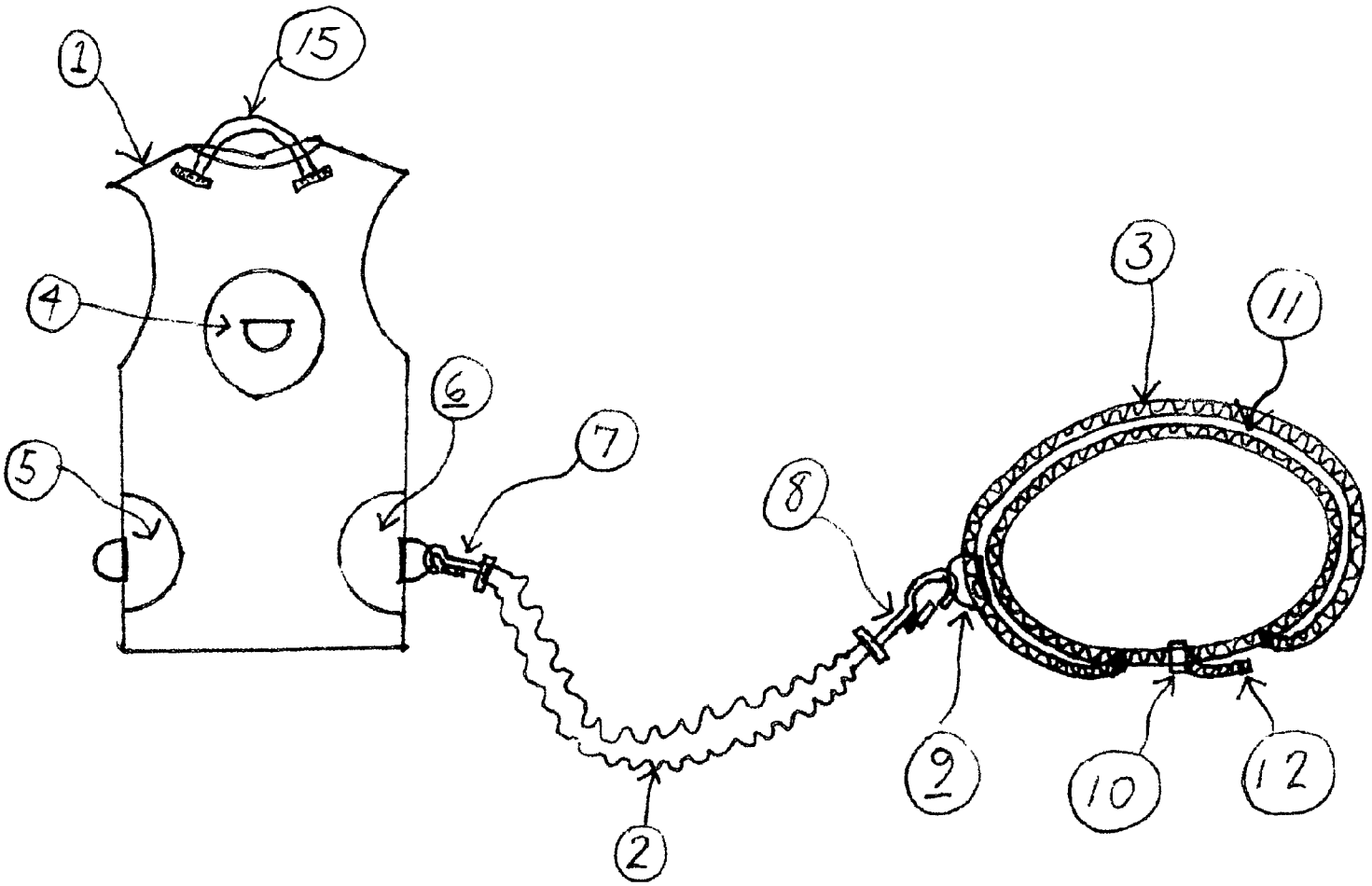

Life jackets, or more appropriately, personal floatation devices, have been in use for many years and no doubt have saved countless lives; hence the aptly coined label 'life jacket' has stuck. These life saving devices are used in almost all water activities to provide extra floatation in times when it is needed. Even the strongest swimmer will eventually find the need for a life jacket if exposed to open water long enough. Needless to say, they are a Coast Guard required safety device for all sea-going vessels, and are the absolute minimum that should accompany any water-borne recreational activity or excursion. Also, due to their added buoyancy, they are frequently used to help children and novice swimmers practise their skills at pools and beaches alike. It is from these everyday beach-going activities where the inspiration for our system originates. Not long ago, on a family vacation to the beach, we purchased a nice youth life jacket for our young 2 year old child. We were, of course, trying to be safe and err on the side of caution, even though we had no intention of allowing him out of our sight. Having him in the life jacket actually gave us a somewhat false sense of security in that if he got away from us in the water we knew he would float. Very quickly we learned that just having a life jacket on our boy was not enough to play with him in choppy water. The waves at the shore we were visiting, like most beaches, could very quickly go from fairly calm to very rough, which was unsettling. On more than a few occasions we really had to fight to prevent from being separated from our boy, even with him wearing a life jacket in only waist deep water. It was precisely then that we realised a life jacket, on its own, was not sufficient for our needs. Something would have to be done. We felt the strong need for an additional safety measure that would prevent a child from becoming separated from the parent and swept out into deeper water.

SUMMARY OF INVENTION

We propose a new safety-retrieval system that is comprised of three [3] main components. These components are a life jacket (personal floatation device) with one or more reinforced tethering points, a waistband/belt also with one or more tethering points to be worn around a secondary person's waist (other than the life jacket wearer), and a leash/tethering line to connect the life jacket to the waist belt. This system will have varied uses but will initially be designed to allow a novice or weak swimmer to be tethered to a more experienced swimmer to provide added control and safety in times when water conditions are rough or unpredictable. The system will initially be targeted towards parents who desire added security and 'piece of mind', when their young children and youths are learning to swim, but will be just as helpful, and practicable, to people of any age that may need guidance, assistance, or just some added security.

DETAILED DESCRIPTION

Our invention and safety-retrieval system starts with a Coast Guard Approved personal floatation device. We then add tethering points, in the form of D-rings, O-rings, or both, stitched to the jacket in various locations. These life jackets may have only one or several tethering points. The most common configurations will have these tethering points either centered on the back of the jacket, on both sides of the jacket just above the waist line, on the upper front portion of the jacket (offset from centerline), or both sides and back. All points of attachment (tethering points) on the jacket will be stitched all the way through to the inside surface of the jacket and will be done in such a way so as to distribute any pulling (tensile) force applied to the associated ring over at least a 2 square inch area. Furthermore, all stitching will be doubly done (at least double-stitched) to bolster the strength of all attachment points. The next part of our system is the actual tether, or safety leash. It will be of varying lengths and have clasps at one or both ends to be attached or removed from the life jacket. The last part of our system is the waist belt. It will be adjustable for varying waist sizes and more importantly have reinforced D-ring or O-ring attachment points for the tether to be fastened. These three components make up our safety-retrieval system.

*Those skilled in arts similar to which this invention is based will appreciate that the conception, upon which this design is based, may readily be utilised as a basis for designing other structures, methods, and systems for carrying out the several purposes of the present invention. It is therefore important that the claims of this disclosure be regarded as including equivalent constructions to such an extent that they do not deviate from the spirit and scope of the present invention.

Figure 2:
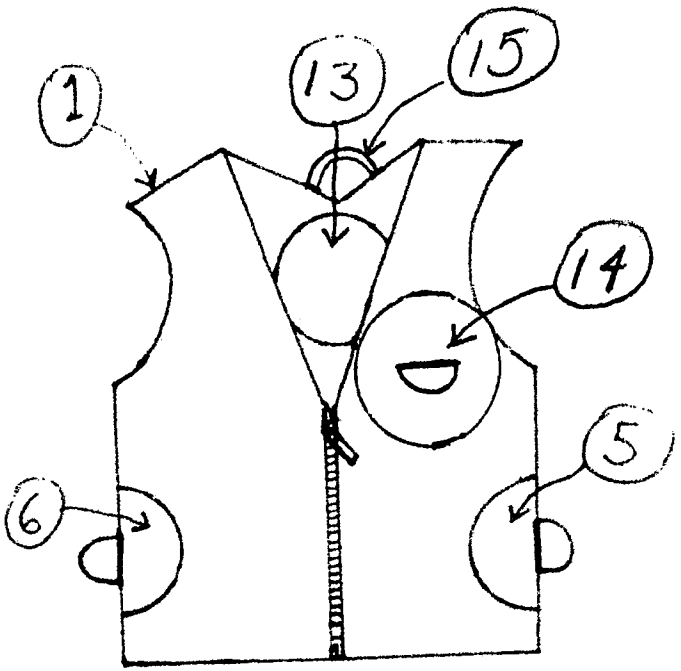

EXPLANATION OF DRAWINGS (In Reference to FIGS. 1 and 2; Description of Items 1 Through 15 Shown in Drawings are Listed after FIG. 2)

FIG. 1 shows all three elements of our Safety Belt Swim Trainer and how they will be used in conjunction. The left portion of FIG. 1 shows the rear view of a typical life vest style personal floatation device (pfd) with our D-ring design, having D-ring patches affixed to both sides as well as the back (rear) of the vest. The right side of FIG. 1 shows a waist belt with an adjustable Velcro style closure and a sliding D-ring to allow attachment of a leash style tether, pictured in the center of the page, which connects the PFD to the waist belt. The D-ring attached to the waist belt will be free to move around the wearer's waist.

FIG. 2 shows a frontal view of our life vest with D-rings attached to the sides, front, and back. The inner reinforcement patch shown on the inner surface of the back of the life vest is connected to the rear (back) D-ring to distribute tensile forces. Although not shown, the side and front D-rings will also have inner reinforcement patches similar to the rear D-ring.

ITEMS ON FIGS. 1 AND 2

(Item Numbers are Enclosed by a Circle)

1. Life Vest with D-ring Patches.
2. Nylon/Bungee Style Leash with Clasps.
3. Waist Belt with Special Channel and Sliding D-ring,
4. Rear (Back) D-ring Patch.
5. Left Side D-ring Patch.
6. Right Side D-ring Patch.
7. Snap Barrel Type Clasp.
8. Snap Barrel Type Clasp.
9. Sliding D-ring.
10. Waist Belt Buckle.
11. Channel for Sliding D-ring.
12. Adjustable Velcro Portion of Waist Belt.
13. Inner Reinforcement Patch.
14. Front D-ring Patch.
15. Grab Loop.

We claim:

1. A safety-retrieval system comprised of the following three [3] components: (a.) A life jacket (PFD) with either one or more D-ring/O-ring attachment points affixed to said PFD and reinforced so as to distribute a pulling/tensile force on any individual D-ring/O-ring over at least a 2 square inch area, (b.) A waistband/belt to be worn around a secondary person's waist, other than the wearer of said PDF from (a.), with one or more D-ring/O-ring attachment points which are free to slide about said belt, and (c.) A safety line/tether with clasps at one or both ends so that said PFD described above in (a.) may be connected and disconnected at will to said waistband/belt described above in (b.).

2. A safety-retrieval system comprised of a PFD as described above in claim 1(a.) and a safety line/tether as described above in claim 1(c.) wherein one end of said safety tether is permanently affixed, or removably attached by means of a clasp, to one of the D-ring/O-ring attachment points on said PFD while the other end of said safety tether has a clasp that is free to be connected or disconnected to an external attachment point of choice.

3. A safety-retrieval system comprised of a waistband/belt as described above in 1(b.) and a safety tether as described above in 1(c.) wherein one end of said safety tether may be permanently affixed, or removably attached by means of a clasp, to one of the D-ring/O-ring attachment points on said waistband while the other end of said safety tether has a clasp that is free to be connected or disconnected to an external attachment point of choice.

4. A PFD as described above in claim 1(a.) with or without a grab loop affixed to the upper-back portion of said PFD.

5. A waistband/belt as described above in claim 1(b.) with one or more D-ring/O-ring attachment points that are free to slide about said belt and hence a wearer's waist.

6. A safety-retrieval system comprised of the following three [3] components: (a.) A life jacket (PFD) with either one or more D-ring/O-ring attachment points affixed to the sides of said PFD and reinforced so as to distribute a pulling/tensile force on any individual D-ring/O-ring over at least a 2 square inch area, (b.) A waistband/belt to be worn around a secondary person's waist, other than the wearer of said PDF from (a.), with one or more D-ring/O-ring attachment points which are free to slide about said belt, and (c.) A safety line/tether with clasps at one or both ends so that said PFD described above in (a.) may be connected and disconnected at will to said waistband/belt described above in (b.).

7. A safety-retrieval system comprised of the following three [3] components: (a.) A life jacket (PFD) with either one or more D-ring/O-ring attachment points affixed to the front of said PFD and reinforced so as to distribute a pulling/tensile force on any individual D-ring/O-ring over at least a 2 square inch area, (b.) A waistband/belt to be worn around a secondary person's waist, other than the wearer of said PDF from (a.), with one or more D-ring/O-ring attachment points which are free to slide about said belt, and (c.) A safety line/tether with clasps at one or both ends so that the PFD described above in (a.) may be connected and disconnected at will to the waistband/belt described above in (b.).

* * * * *